US009254954B2

(12) United States Patent
Davideit et al.

(10) Patent No.: US 9,254,954 B2
(45) Date of Patent: Feb. 9, 2016

(54) METERING VALVE

(71) Applicant: Summit Packaging Systems, Inc., Manchester, NH (US)

(72) Inventors: Daniel E. Davideit, Manchester, NH (US); Kevin G. Verville, Deerfield, NH (US)

(73) Assignee: SUMMIT PACKAGING SYSTEMS, INC., Manchester, NH (US)

( * ) Notice: Subject to any disclaimer, the term of this patent is extended or adjusted under 35 U.S.C. 154(b) by 0 days.

(21) Appl. No.: 14/181,219

(22) Filed: Feb. 14, 2014

(65) Prior Publication Data

US 2014/0158719 A1 Jun. 12, 2014

Related U.S. Application Data

(63) Continuation-in-part of application No. 12/859,078, filed on Aug. 18, 2010.

(51) Int. Cl.
*B65D 83/00* (2006.01)
*B65D 83/62* (2006.01)
(Continued)

(52) U.S. Cl.
CPC ..... *B65D 83/62* (2013.01); *B65D 83/48* (2013.01); *B05B 1/3066* (2013.01); *B65D 83/54* (2013.01); *B65D 83/546* (2013.01); *Y10T 29/49412* (2015.01)

(58) Field of Classification Search
CPC ..... B65D 83/48; B65D 83/54; B65D 83/546
USPC ..... 222/402.1, 402.2, 402.24, 509, 514, 222/518
See application file for complete search history.

(56) References Cited

U.S. PATENT DOCUMENTS 2,686,652 A * 8/1954 Carlson et al. ..... 222/402.24
2,778,543 A * 1/1957 Urlaub ..... 222/402.2
(Continued)

FOREIGN PATENT DOCUMENTS

EP 2253560 11/2010
FR 1 598 257 7/1970
(Continued)

OTHER PUBLICATIONS

Machine Translation of FR1598257, 4 pgs.*
(Continued)

*Primary Examiner* — Daniel R Shearer
(74) *Attorney, Agent, or Firm* — Davis & Bujold PLLC; Michael J. Bujold

(57) ABSTRACT

The present invention is directed to a metering valve used in both conventional and bag-on-valve aerosol container applications that allows a high flow rate of especially viscous substances. The metering valve according to the present invention including a valve housing, a valve stem, and a spring or other biasing device that allows the valve stem to move relative to the valve housing. The valve stem serves as a metering chamber with a metering device in the form of a ball or disk without other mechanisms such as springs or mechanical parts within the valve stem. Radial bores and a seal near the bottom of the valve stem provide for dispensing of pre-determined quantities of product from an aerosol container pressurized with liquefied propellants or compressed gas. The bore shape and size can be selected to facilitate a high volume flow rate for highly viscous substances.

19 Claims, 14 Drawing Sheets

(51) Int. Cl.

| | |
|---|---|
| ***B65D 83/48*** | (2006.01) |
| *B65D 83/54* | (2006.01) |
| *B05B 1/30* | (2006.01) |

(56) References Cited

U.S. PATENT DOCUMENTS

| | | | | | |
|---|---|---|---|---|---|
| 3,018,928 | A | | 1/1962 | Meshberg | |
| 3,081,919 | A | | 3/1963 | Samuel | |
| 3,169,677 | A | | 2/1965 | Focht | |
| 3,186,605 | A | * | 6/1965 | Potoczky | 222/402.11 |
| 3,491,921 | A | * | 1/1970 | Gorman | B65D 83/48 222/402.24 |
| 3,722,759 | A | * | 3/1973 | Rodden | B65D 83/48 137/529 |
| 3,738,542 | A | | 6/1973 | Ruscitti | |
| 3,779,464 | A | | 12/1973 | Malone | |
| 4,046,292 | A | | 9/1977 | Corsette | |
| 4,122,982 | A | | 10/1978 | Giuffredi | |
| 4,896,799 | A | | 1/1990 | Giuffredi | |
| 5,002,207 | A | | 3/1991 | Giuffredi | |
| 5,092,495 | A | | 3/1992 | Andre | |
| 5,301,852 | A | | 4/1994 | Mancini | |
| 5,429,280 | A | * | 7/1995 | Bauer | B65D 83/52 222/402.2 |
| 5,462,208 | A | | 10/1995 | Stahley et al. | |
| 5,791,527 | A | | 8/1998 | Giuffredi | |
| 7,637,399 | B2 | | 12/2009 | Marroncles et al. | |
| 8,505,779 | B2 | | 8/2013 | Lilienthal et al. | |
| 2005/0121476 | A1 | * | 6/2005 | Pauls et al. | 222/402.24 |
| 2009/0294719 | A1 | | 12/2009 | Jeske et al. | |
| 2011/0101037 | A1 | | 5/2011 | Ghavami-Nasr et al. | |
| 2011/0108582 | A1 | | 5/2011 | Ghavami-Nasr et al. | |
| 2011/0127300 | A1 | | 6/2011 | Ghavami-Nasr et al. | |
| 2011/0186655 | A1 | | 8/2011 | Ghavami-Nasr et al. | |
| 2011/0248099 | A1 | | 10/2011 | Ghavami-Nasr et al. | |
| 2012/0043353 | A1 | | 2/2012 | Davideit et al. | |
| 2013/0092710 | A1 | | 4/2013 | Bodet et al. | |

FOREIGN PATENT DOCUMENTS

| | | | | |
|---|---|---|---|---|
| FR | 1598257 | A | * | 8/1970 |
| GB | 2 474 360 | A1 | | 4/2011 |
| JP | 2010-36947 | A | | 2/2010 |

OTHER PUBLICATIONS

International Search Report Corresponding to PCT/US2015/015799 mailed Jun. 4, 2015.

* cited by examiner

METERING VALVE

RELATED APPLICATION

This application is a continuation-in-part application of and claims the benefit of pending U.S. application Ser. No. 12/859,078 filed Aug. 18, 2010 and published as U.S. Publication No. 2012/0043353 published on Feb. 23, 2012 and entitled HIGH FLOW AEROSOL VALVE which is hereby incorporated herein by reference in the entirety.

FIELD OF THE INVENTION

The present invention relates to a metering valve that dispenses a pre-determined quantity of material from a container under pressure of an aerosol or compressed gas that is simple in structure and readily manufactured. The present invention further relates to a high flow valve used in compressed gas, aerosol and bag-on-valve applications, and particularly to a valve having a housing that is supported by a mounting cup for a product container or can, and communicates with a product or product containment bag inside the can, where the radial opening of the valve is positioned closer to a lower seal of the valve stem rather than an upper seal or mounting cup gasket facilitating an increased flow rate for dispensing the product from the container and valve. The valve stem serves as a metering chamber with a metering device within the valve stem that seals the valve stem from the container in a pre-dispensing position and seals the exit orifice of the chamber after dispensing from the valve stem metering chamber the pre-determined quantity of material.

BACKGROUND OF THE INVENTION

Standard aerosol valve and gasket assemblies for dispensing pressurized product from a container have an inherent structural problem which limits the flow rate of product out of the container and through the valve stem. As is well known, the gasket which seals the conventional radial opening of the spring biased valve in the valve housing of conventional aerosol valves also seals the valve stem with the mounting cup of the container limiting the diameter of the opening relative to the valve stem extending through the gasket. The valve stem is provided with both an axial and a radial opening for dispensing product from the container. When the valve stem is pushed down by a user against a spring bias, the radial opening which is initially blocked by the gasket comes into fluid communication with the product in the container which is then permitted to flow through the radial opening and out the valve stem to the environment. Once the user releases the valve stem, the valve stem is biased back into a closed position with the radial opening blocked by the mounting cup gasket.

The structural problem is two-fold, first the radial opening in the side of the valve stem must be smaller than the thickness of the gasket so that the opening is adequately covered in the closed valve position, otherwise there is a substantial risk of the product being able to escape even when the valve is closed by leakage through the radial opening. The general thickness of a conventional gasket is in the range of 1.02 mm-1.52 mm (0.04-0.06 in.), so the radial openings must be substantially within this range. This along with tolerances necessary to ensure complete closure of the valve limits the size of the radial opening. Secondly, the larger the radial opening is on the upper portion of the valve stem where it is located in such conventional valve stems, the more the structural integrity of the valve stem is affected. If the opening is too large the valve stem when subjected to axial and radial forces during depression by a user can fail and break, bend or otherwise permanently damage the valve stem. Such restrictions in the size of the radial opening in the stem make it difficult to obtain high flow rates of product and a highly viscous product such as toothpaste cannot be dispensed without a sufficiently large passage in the valve stem.

Similarly, in other applications such as bag-on-valve assemblies, such valve stem openings create the same or similar structural issues. Collapsible and highly flexible product bags or pouches have become common in different industries for containing a variety of food, beverage, personal care or household care or other similar products. Such product bags can be used alone to allow a user to manually squeeze and dispense a product from the bag or the product bags may be utilized in combination with a pressurized can and product, for example an aerosol. Such product bags and valves contained in and used with aerosol cans are generally referred to in the aerosol dispensing industry as bag-on-valve (BOV) technology. These product bags, valves and cans may be designed to receive and dispense a desired product in either a liquid or semi-liquid form which have a consistency so as to be able to be expelled from the valve or outlet when desired by the user.

Bag-on-valve technology is known to utilize a product dispenser, such as a can, which has the collapsible product bag inserted therein prior to filling of the bag with a product. The bag is initially flat and inserted axially into the can usually in a rolled up manner and having a filling/dispensing valve communicating with the inside of the product bag. The valve is affixed as in the conventional valve described above to a mounting cup portion of the valve and the mounting cup is crimped to the can. During a final manufacturing phase the product bag is filled with the desired product.

In the filling process, a desired product is inserted into the product bag via the two-way valve by appropriate filling means. When the bag is filled by the filling mechanism, the product bag expands inside the can. At some point in the manufacturing process, the can is provided with a pressurized gas in order to assist in squeezing the bag to expel the contents thereof as is well known in the art. Many factors influence the expulsion of the contents or product from the can out of the valve into the environment. The valve is a key component, which has lead to the design of multiple valve configurations for different applications.

Typically, bag-on-valve applications have used valves that have two components—a valve housing and a valve stem. In most applications, the valve housing engages with a mounting cup of a can, attaches to a bag that holds the product, and provides the framework for the valve stem. The valve stem usually interacts with the valve housing through the use of a spring. The spring allows the valve stem to move relative to the valve housing to open and close the valve. Typically, when the valve is opened, product flows from the product bag, to and through the valve housing, then through a passage in the valve stem, and finally into the environment. The passage is normally limited in size and shape based on the sealing of the passage by the upper gasket that is used to seal the valve housing to the mounting cup.

An issue associated with the bag-on-valve technology is control of the volume flow of the product contents of the bag from the system to the environment. This issue is especially compounded due to the different viscosities of the various products which manufacturers dispense from such bag-on-valve containers. The various product contents include liquids, creams, foams, gels, aerosols, colloids, and various other substances. Handling the flow of a highly viscous substance such as for instance, toothpaste is particularly difficult in both conventional and bag-on-valve applications where the aerosol dispensing radial passages are particularly small in the 1.02 mm-1.52 mm (0.04-0.06 in.) range and there is no structural feasibility to make these holes larger with conventional valve structures. The problem is to be able to accommodate larger dispensing openings in the valve beyond the 1.02 mm-1.52 mm (0.04-0.06 in.) range in order to accommodate higher flow rates and more viscous product.

The present invention addresses the required increased flow rate necessary in some bag-on-valve applications. In some aerosol applications, however, the bag-on-valve containers may not be feasible due to volume constraints of the container and cost considerations even though it may be undesirable to mix the propellant gas with the product material. In these instances immiscible gases, such as nitrogen or carbon dioxide may be preferred. The present invention provides for liquefied propellants or compressed gas such as air, nitrogen or carbon dioxide to be used and further may provide metered doses of product as required in some aerosol applications.

OBJECTS AND SUMMARY OF THE INVENTION

The present invention is directed to a valve used in both conventional and bag-on-valve aerosol container applications that allows a high flow rate of especially viscous substances. In a first embodiment of the present invention, the valve includes a valve housing, a valve stem, and a spring or other biasing device that allows the valve stem to move relative to the valve housing. The valve stem is substantially hollow to allow the flow of product to and from a bag attached to the valve housing. There is a radial bore or bores and a seal near the bottom of the valve stem that dictate the passage and flow rate of pressurized product between the product container and the environment. The radial bore at the bottom or lower portion of the valve stem provides for flow directly from the product reservoir to the valve stem passage when a lower seal on the valve is opened. The valve stem passage is sealed by the lower seal or ring which is a separate sealing gasket or ring from the upper gasket. The lower seal may be located anywhere along the valve stem below the upper gasket and preferably at the bottom or lower portion of the valve stem facilitating communication to the product reservoir.

As a reference point the upper portion of the valve stem and upper gasket refers to the end of the valve stem and the gasket adjacent the orifice in the mounting cup. The lower portion of the valve stem and the lower gasket or ring are located axially spaced below the upper portion and generally more interior of the container so that product ejected from the container when the valve is actuated travels from the lower portion of the valve stem past the lower gasket or ring up through the upper portion of the valve stem and out of the valve.

The addition of a lower sealing gasket or ring allows one or more larger diameter bore(s) to be radially formed in the lower portion of the valve stem without compromising the integrity of the valve stem itself. The bore shape and larger size can be selected to facilitate a high volume flow rate for highly viscous substances. For example a triangular or polygonal shape could provide a variable flow rate into and through the valve stem to ensure that highly viscous materials are dispensed at a desired flow rate depending on a user's actuation pressure. It is, therefore, an object of the present invention to overcome the above noted issues and produce a valve for both conventional aerosol valve and bag-on-valve systems which facilitates a high volume flow rate for liquids and semi-liquids of different viscosities.

In a further embodiment, a metering device such as a metal, ceramic or plastic ball is positioned within the valve stem to provide for dispensing a metered dose of product. The use of a metering device within a metering chamber is well known, with many aerosol valve designs of the prior art showing elaborate, costly and difficult to manufacture mechanisms having one or more mechanical springs, plungers, and other contrivances within the metering chamber to control the movement and positioning of the metering device. What is not shown in the prior art is the placement of the metering device within the valve stem. In the present invention, the location of the sealing ring at the base of the valve stem provides for radial inlet passages to be positioned below a lower sealing rim that using the metering device seals the pre-determined quantity of product within the valve stem from the product within the container. Because the metering device is within the valve stem, a propellant such as a compressed gas within the container can be used because the propellant acts directly on the metering device to force the metering device through the valve stem and dispense the pre-determined quantity of product. By acting directly on the metering device, a common problem of using compressed or immiscible gas is alleviated, where the compressed gas is not valved off in a metering chamber and therefore left without means to dispel it therefrom. In the present invention, the propellant acts directly on the metering device to dispense the pre-determined quantity that is defined by the volume of the valve stem. This volume may therefore be adjusted by changing the length and diameter of the valve stem, which as a single piece may be interchangeable and be easily replaced in the valve housing to provide for larger or smaller required dosage volumes for specific products and applications.

The valve stem is initially filled with product through a priming actuation by fully or partially compressing the valve stem. Once primed, by compressing the valve stem, the propellant which may be a compressed gas forces the ball as a metering device off of a lower sealing rim to travel up and through the valve stem thereby dispensing the quantity of product within the valve stem. The ball engages an upper sealing rim at the outlet orifice of the valve stem to seal and prevent further product from being dispensed to the inlet passage of the actuator and nozzle. As the actuator is released, delivery of the product through the nozzle stops and the ball returns downward to a rest position on the lower sealing rim. The valve stem as the metering chamber is therefore filled with the pre-determined quantity of product for dispensing another metered dose. A small conduit may be provided at the upper sealing rim. The conduit provides communication between the valve stem and air external to the aerosol container in order to provide a pressure differential on each side of ball to release the ball from the upper sealing position after the valve is released. It is therefore an object of the invention to provide for a metering device within the valve stem to simplify the assembly and cost of a metering valve.

It is another object of the present invention to provide a valve stem that serves as metering chamber with a metering device to dispense pre-determined quantities of product based on the volume of the valve stem.

It is another object of the present invention to provide radially passages to a valve stem positioned below a lower sealing rim within the valve stem.

It is another object of the present invention to provide a metering valve capable of dispensing pre-determined quantities of product using liquefied propellants or compressed air within an aerosol container.

It is another object of the present invention to easily facilitate varying flow rates based on the point of depression of the valve.

It is a still further object of the present invention to provide a high volume flow rate for highly viscous substances that typically have difficulty being dispensed.

It is yet another object of the present invention to simplify the process of adding and discharging the contents of the aerosol can, container or product bag by allowing the product to go directly from the valve stem into the container or product bag without having to pass through the valve housing.

Another object of the present invention is to provide a two-way valve which permits a substantial increase in the speed of filling a product container or bag, especially in the context of highly viscous substances.

The present invention relates to a valve for use in a pressurized aerosol application, the valve comprising a valve housing having an outer surface for supportive engagement with a mounting cup for a product container and a first cavity defined within the valve housing for receiving valve components comprising, a valve stem springingly engaged with the valve housing, the valve stem defining a central passage for dispensing pressurized product to the environment and a lower end portion including a sealing ring for engaging a sealing edge of the valve housing, and at least one radial bore formed in a sidewall of the valve stem located in the lower end portion of the valve stem, the at least one radial bore leading to the central passage extending from the radial bore to a dispensing orifice at an upper end portion of the valve stem.

The present invention also relates to an actuator for an aerosol container comprising a valve housing defining a cavity for receiving valve components comprising an upper portion for engaging a mounting cup for an aerosol container, a chamber for containing a spring, and a lower sealing edge defining an opening into the valve housing; an inner seal between the upper portion of the valve housing and the mounting cup; a valve stem supported within the valve housing and axially moveable relative thereto in accordance with the spring, the valve stem comprising; a passage extending between a radial opening at a lower end of the valve stem and an axial opening at an upper end of the valve stem; and receiving a lower seal supported on the valve stem between the radial opening and a lowermost end of the valve stem.

The present invention also relates to a method of making an actuator for dispensing product from an aerosol container through the actuator comprising the steps of providing a valve housing defining a cavity for receiving valve components comprising the steps of engaging an upper portion of the valve housing in a mounting cup of the aerosol container, forming a chamber for containing a spring, and placing a lower sealing edge defining an opening into the valve housing; providing an inner seal between the upper portion of the valve housing and the mounting cup; supporting a valve stem within the valve housing and axially moveable relative thereto in accordance with the spring, the valve stem comprising the steps of; extending a passage between a radial opening at a lower end of the valve stem and an axial opening at an upper end of the valve stem; and placing a lower seal on the valve stem between the radial opening and a lowermost end of the valve stem.

The present invention further relates to a metering valve for use in a pressurized aerosol application, the valve comprising a valve housing having an outer surface for supportive engagement with a mounting cup for a product container and a first cavity defined within the valve housing for receiving valve components comprising, a valve stem springingly engaged with the valve housing, the valve stem defining a central passage for dispensing pressurized product to the environment, and comprising a metering device, an upper and lower sealing rim, and a lower end portion including a sealing ring for engaging a sealing edge of the valve housing, and at least one radial bore formed in a sidewall of the valve stem located in the lower end portion of the valve stem below the lower sealing rim, the at least one radial bore leading to the central passage extending from the radial bore to a dispensing orifice positioned above the upper sealing rim at an upper end portion of the valve stem, and wherein the metering device is longitudinally movable within the valve stem from a rest position sealing the valve stem from the container at the lower sealing rim and an actuated position dispensing a pre-determined quantity of product from the valve stem and then sealing the dispensing orifice at the upper sealing rim of the valve stem. The propellant within the container of the pressurized product acts directly on the metering device of the metering valve to dispense the pre-determined quantity of product. The propellant may be compressed gas such as an immiscible gas. The metering valve further comprises at least one micro-vent at the upper sealing rim of the valve stem to communicate externally to the container. The upper sealing rim of the valve stem of the metering valve is circumferentially tapered and the dispensing orifice is of a smaller diameter than the metering device. The metering valve further comprising a first radial bore and a second radial bore located in the lower end portion of the valve stem below the lower sealing rim, and the first bore is located circumferentially opposite the second bore in the valve stem. Further, the lower sealing rim of the valve stem is circumferentially tapered from a diameter of the valve stem to the central passage extending from the radial bore and the sealing edge of the valve housing may comprise a concave curvature to accept and seal against the sealing ring. The metering device may be a ball of a stainless steel, ceramic or plastic material. In an embodiment a dip tube may be affixed to the valve housing. The metering valve may further have at least one bore in the valve stem that axially decreases in cross-sectional area along the valve stem or at least one bore in the valve stem that axially increases in cross-sectional area along the valve stem to change the flow of product through the valve stem.

The present invention is further related to an actuator for dispensing a pre-determined quantity of product from an aerosol container comprising a valve housing defining a cavity for receiving valve components comprising, an upper portion for engaging a mounting cup for an aerosol container, a chamber for containing a spring, and a lower sealing edge defining an opening into the valve housing, an inner seal between the upper portion of the valve housing and the mounting cup, a valve stem supported within the valve housing and axially moveable relative thereto in accordance with the spring, the valve stem comprising, a metering ball, an upper sealing rim at an axial opening at an upper end of the valve stem, a lower sealing rim at a lower end of the valve stem, a radial opening positioned below the lower sealing rim, and a lower seal supported on the valve stem between the radial opening and a lowermost end of the valve stem, and wherein the metering device seals against the lower sealing rim in a closed position of the actuator, and seals against the upper sealing rim in an open position of the actuator thereby dispensing a pre-determined quantity of product from the aerosol container.

The actuator for an aerosol container may further comprise in the unactuated position, the valve housing engaged with the sealing ring and in an actuated position the valve housing spaced from the sealing ring wherein product in the container can communicate with the radial opening of the valve stem. In an actuated position propellant acts directly on and displaces the metering ball from the lower sealing rim filling the valve stem with product until the metering ball seals against the upper sealing rim. The valve stem of the actuator for an aerosol container may in a fully or partially actuated position prime the metering valve.

The present invention is further related to a method of making an actuator for dispensing a pre-determined quantity of product from an aerosol container comprising the steps of providing a valve housing defining a cavity for receiving valve components comprising the steps of engaging an upper portion of the valve housing in a mounting cup of the aerosol container, forming a chamber for containing a spring, and placing a lower sealing edge defining an opening into the valve housing, providing an inner seal between the upper portion of the valve housing and the mounting cup, supporting a valve stem within the valve housing, the valve stem being axially moveable relative thereto in accordance with the spring, and the forming of the valve stem comprising the steps of locating a metering device within the valve stem, forming an upper sealing rim at the outlet orifice of the valve stem, forming a lower sealing rim at the lower end of the valve stem, extending a radial passage at a lower end of the valve stem below the lower sealing rim to communicate through the valve stem with the outlet orifice, and placing a lower seal on the valve stem between the radial opening and a lowermost end of the valve stem. The method of dispensing a pre-determined quantity of product from an aerosol container may further comprise the steps of defining an unactuated position by engaging the lower seal on the valve stem to the lower sealing edge of the valve housing and sealing the metering device against the lower sealing rim, defining an actuated position by compressing the valve stem and thereby spacing the lower seal from the lower sealing edge of the valve housing thereby delivering product in the container through the radial opening to the valve stem by displacing the metering device from the lower sealing rim, the propellant of the container acting directly on the metering device to force the pre-determined quantity of product from the valve stem through the outlet orifice to a point of sealing the metering device against the upper sealing rim, and defining a partially actuated position by releasing the valve stem from compression and delivering air from a conduit to release the metering device from sealing against the upper sealing rim. The method of dispensing product from an aerosol container by having propellant acting directly on the metering device and the propellant may be an immiscible gas. The method of dispensing product from an aerosol container may further comprise the steps of forming separated first and second radial openings in a sidewall of the valve stem.

These and other features, advantages and improvements according to this invention will be better understood by reference to the following detailed description and accompanying drawings.

DETAILED DESCRIPTION OF THE PREFERRED EMBODIMENTS

Figure 1:
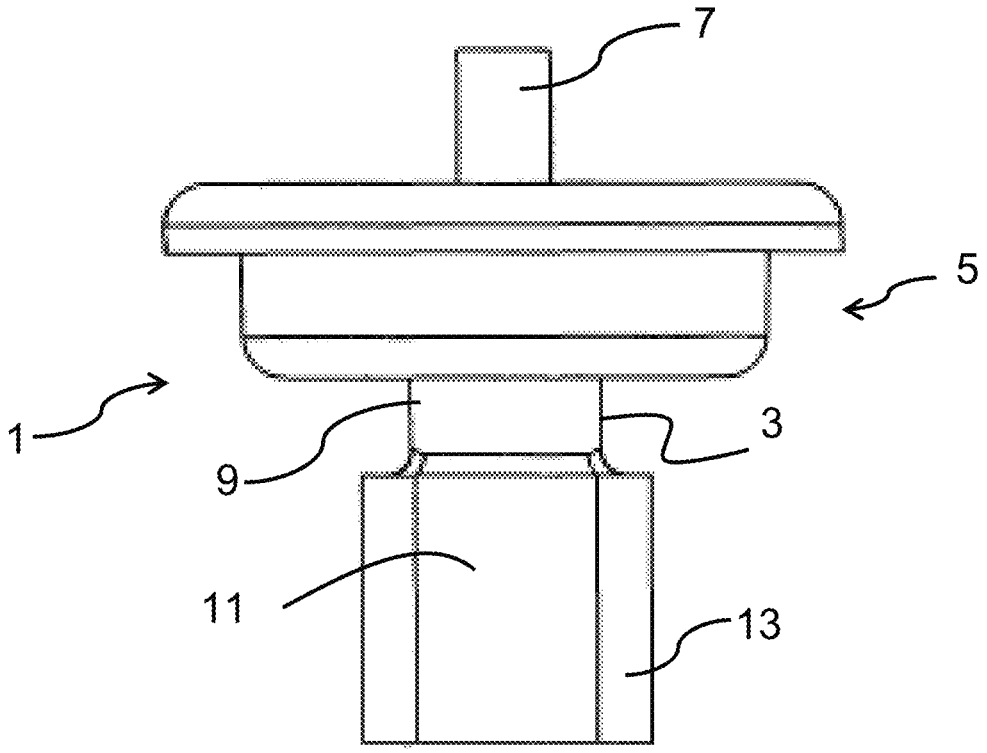
FIG. 1 is a side elevation view of a valve of a first embodiment of the present invention in conjunction with a mounting cup.

FIG. 1 illustrates a side view of an embodiment of the present invention illustrating the valve 1 in conjunction with the mounting cup 5 for a product containing can or container (not shown) in a bag-on-valve system. The valve stem 7 is parallel with and extends out of the valve housing 3 through the mounting cup 5. The valve housing 3 has multiple sections or portions that correspond to different functions for the bag-on-valve application. As is known in the art, a top portion of the valve housing is engaged generally by crimping with the mounting cup to secure the valve housing 3 to the mounting cup 5. The middle portion of the valve housing 3 is the spring cavity 9, which generally houses a spring for controlling dynamic movement between the valve stem 7 and the valve housing 3. The bottom portion 11 of the valve housing 3 can engage with either a dip tube, or as described in the first embodiment, with a product bag in the case of a bag-on-valve. In the present embodiment the bottom portion 11 seals with a top edge of the product bag B along a fitment 13 and the valve 1 is used to dispense the contents or product from the bag. It is to be appreciated that the valve 1 can be a two-way valve which would allow for product to be inserted into the bag through a filling process as well as dispensed therefrom.

Figure 2:
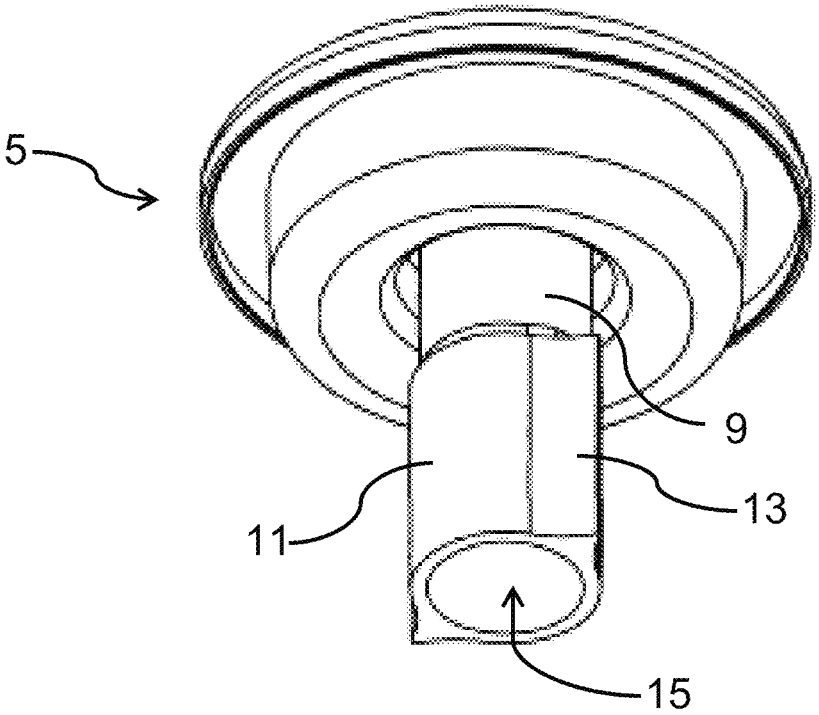
FIG. 2 is a perspective view of a first embodiment of the present invention in conjunction with a mounting cup.

The bottom portion 11 is better illustrated in the perspective view of FIG. 2. The fitment 13 on the bottom portion 11 that assists in the sealing engagement between the base and the product bag is more fully described in Applicant's U.S. patent application Ser. No. 12/667,423 the subject matter of which is herein incorporated by reference. This view also shows the entrance to cavity 15 of the valve housing 3 that receives the product from the bag when a user operates the valve into an open state to dispense the product. The entrance to cavity 15 may or may not communicate with a dip tube which extends down into the lower edges and corners of the bag to facilitate complete product dispensing.

Figure 3:
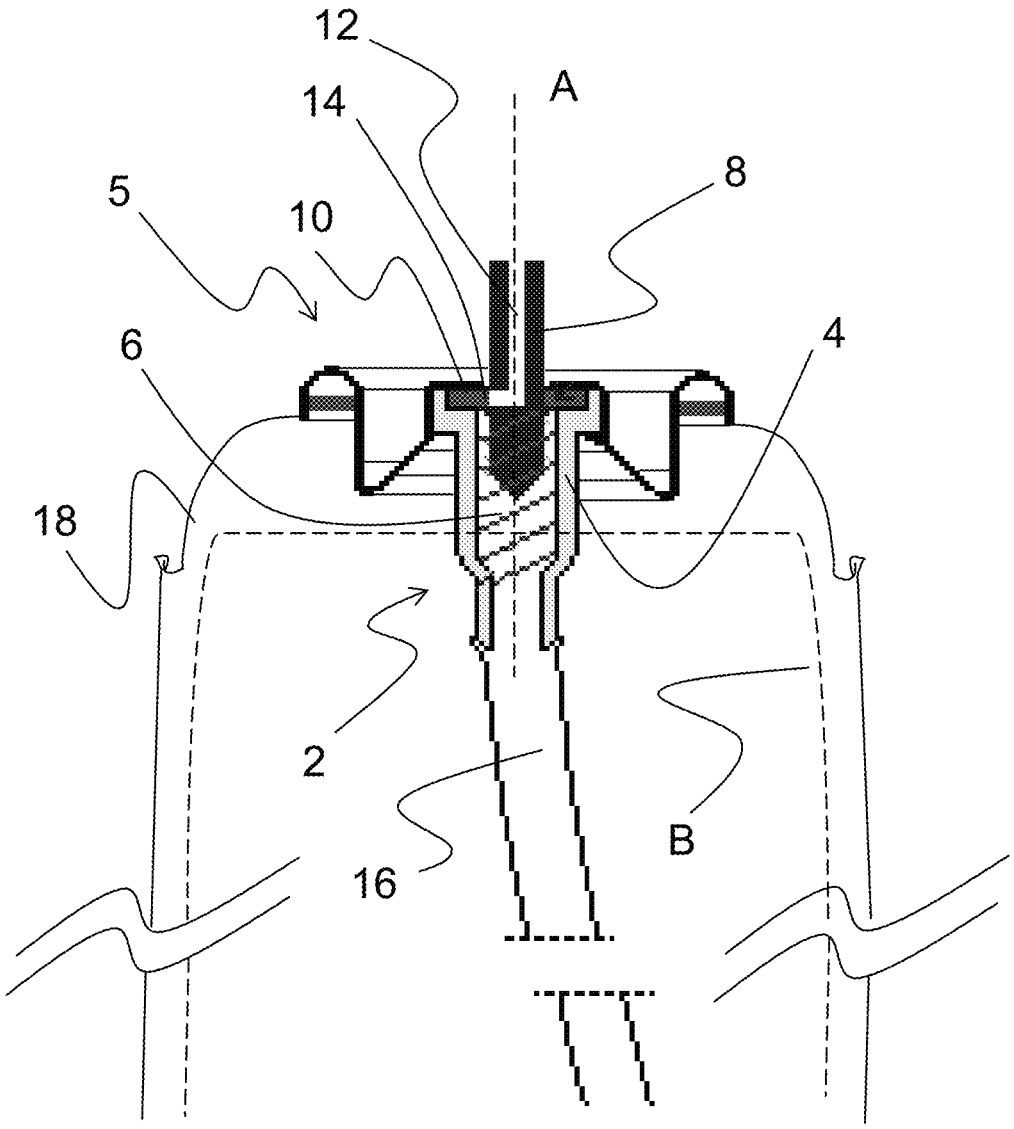
FIG. 3 (PRIOR ART)
FIG. 3 is a cross-sectional view of a valve of the prior art.

Turning to FIG. 3 a cross-sectional view of a conventional valve 2 of the prior art is shown. The valve 2 having a valve stem 8, a valve housing 4 a valve spring 6 and valve gasket 10 and secured to a mounting cup 5. The valve 2 is actuated by compressing the valve stem 8 and valve spring 6 along axis A to a point below the seal of the gasket 10, so that product may flow from the bag B through the product passage 12 and out from the valve container. The gasket 10 also seals the valve housing 4 to the mounting cup 5. The bag B is within the aerosol container 18. The spring 6 biases the valve 2 in a normally closed position as shown with the opening to the product passage 14 sealed against the gasket 10. In the prior art, product is flowing along the valve housing 4, up and around the valve stem 8 to the product passage 12. The valve 2 may or may not have a dip tube 16.

Figure 3A:
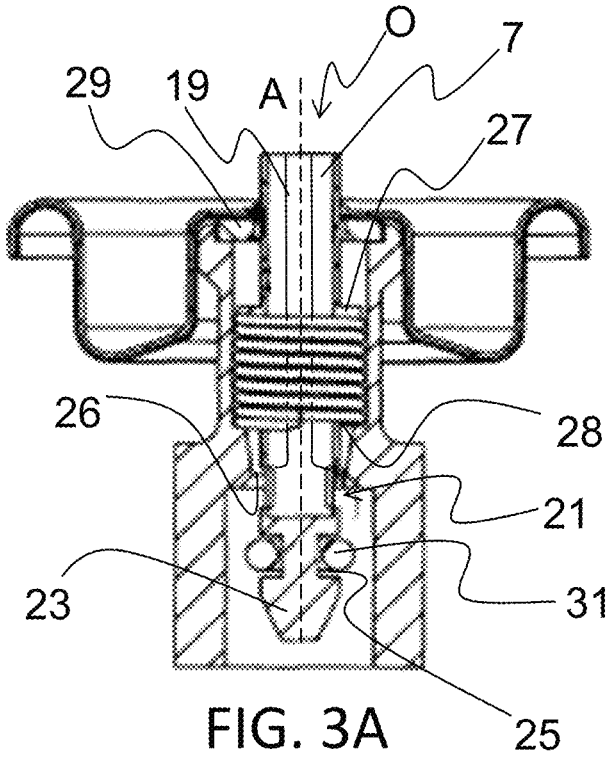
FIG. 3A is a cross-sectional view of a first embodiment of the present invention in conjunction with a mounting cup illustrating a fully closed position.
Figure 3B:
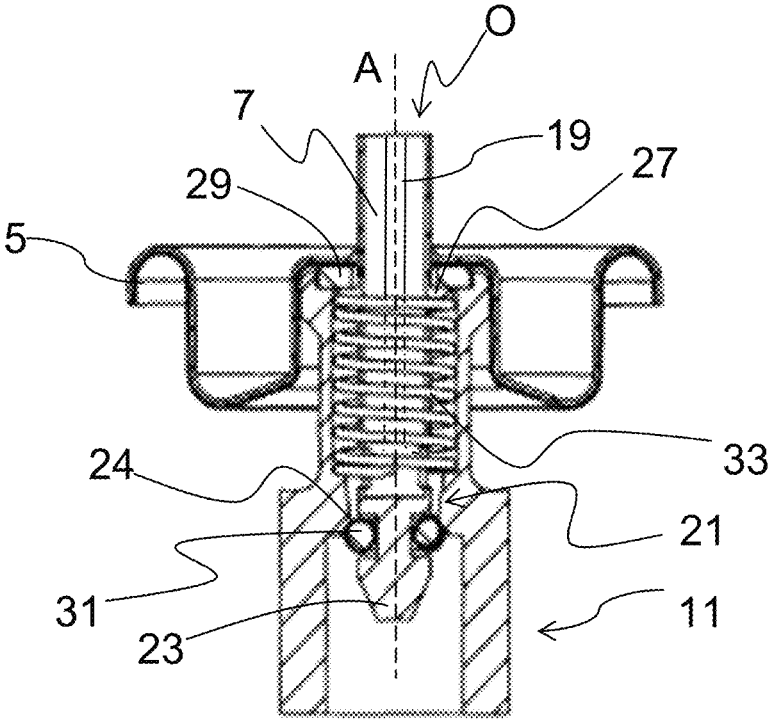
FIG. 3B is a cross-sectional view of a first embodiment of the present invention in conjunction with a mounting cup illustrating a semi-opened position.

As shown in FIGS. 3A and 3B, these cross-sectional views of the bag-on-valve embodiment show the valve housing 3 engaged with the mounting cup 5. An inner gasket 29 is used to form a seal between the valve housing cavity 15, the valve stem 7 and the mounting cup 5. The valve stem 7 extends out of the valve housing 3 and through the mounting cup 5 and is axially biased into a closed position by spring 33. The valve stem 7 is provided with an end sealing portion 23 and a product entrance orifice(s) 21 adjacent the end sealing portion 23 of the valve stem 7. The valve stem 7 is axially disposed along axis A through the valve and can be made of for example PET, PTFE or other polymer material known in the art.

The valve stem 7 defines a product passage 19 that extends substantially the entire length of the valve stem 7. The passage 19 starts from a radial bore(s) 21 adjacent a lower end of the valve stem 19. As described in detail below, the location of the bore(s) 21 near the lower end of the valve stem 7 permits a larger bore opening that consequently allows for greater flow of product contents from the product bag relative to conventional valves into the product passage 19 and out of the valve stem 7.

By compressing the valve stem 7 along the axis A the valve is opened as shown in FIG. 3A and product is dispensed through a main opening O at the uppermost end of the valve stem 7. A nozzle or other dispensing device may be added to the valve stem 7 to direct or control product dispersant. At the opposing lower end, the end sealing portion 23 has a circumferential notch or channel 25 adjacent the tip 23 that receives a lower sealing ring 31, gasket, o-ring or some other type of seal including an overmolded seal. The valve housing 3 is formed with a respective ledge 26 on an inner wall to provide a sealing edge 24 against which the sealing ring 31 abuts to close the valve and prevent the flow of product from leaving the product bag while the valve is in a closed state as seen in FIG. 3B.

The valve stem 7 is engaged within the valve housing 3 and biased into the closed state by the use of spring 33 or another biasing device forcing the stem 7 axially upward and into the closed position with the sealing ring 31 closing the valve against the sealing edge 24. It is to be appreciated that although there is no radial opening or bore in the region of the inner gasket 29, the inner gasket 29 provides a seal between the valve housing 3, the sliding valve stem 7 and the mounting cup 5. The spring 33 keeps the valve stem 7 closed so that the product in the product bag cannot communicate with the environment through the valve 1. The spring 33 has an upper end which typically axially engages the valve stem 7 at a lip or stop 27 that extends partially or completely around an outer wall of the valve stem 7. The lower end of the spring 33 is supported by the valve housing 3 at a circumferential edge 28 around the interior wall of the spring cavity 9. The spring 33 bias provided by the spring 33 allows for the depression and movement of the valve stem 7 relative to the valve housing 3 enabling the valve 1 to be varied between an open state as shown in FIG. 3A, to a closed state as in FIG. 3B.

In the open state shown in FIG. 3A, the product in the container is permitted to flow out of the valve and into the environment. The product contents are able to flow from the product bag or container to the valve 1 through the radial bores 21 in the valve stem 7. The radial bores are located at the lower end of the valve stem 7 adjacent the end sealing portion 23 of the valve stem 7. Although the present embodiment shows two oppositely disposed bores 21 in the figures, the valve stem 7 alternatively could have one, or any number of radial bore(s). The bores 21 are located immediately axially adjacent the lower sealing ring 31 and the end sealing portion 23 to allow an instant flow from the product reservoir to the environment through the valve stem 7 without having an intermediary chamber or circuitous flow path through the valve housing. Product ejection occurs when the valve stem 7 is depressed by a user into the open state, moving the valve stem 7 down relative to the valve housing 3 against the spring bias and motivating the lower sealing ring 31 off the ledge 26 which exposes the radial bore(s) 21 directly to the fluid contents of the container.

FIG. 3A illustrates an open state of the valve 1 that allows the bores 21 to communicate directly with a pressurized flow of product from the product reservoir. Previous valves have been known to place such bores and openings to the passageways near the upper portion of the valve stem, which limits the size of the passageway due to the inability to effectively shut a large passage. In the present invention, the product is stopped by the lower sealing ring 31, which allows the passages or bores 21 to be significantly larger than passages in previous valves that are positioned near the upper portion of the stem as opposed to near the lower sealing ring 31 as in the present embodiment. The larger sized bores 21 which can be formed larger than 1.02 mm-1.52 mm (0.04-06 in.) in diameter, are formed closer to the lower sealing ring 31 and allow for a higher volume flow rate of product out of the product reservoir to the environment. As can be seen in the FIGS. 3A-3B, the bores 21, have a significantly larger diameter than the thickness of the upper inner gasket 29. Because of this larger diameter relative to known smaller diameter radial openings adjacent the inner gasket 29, the presently disclosed valve permits a substantially larger flow rate of product to flow into the valve passage 19 when the valve stem 7 is in a semi or fully open position.

Figure 4:
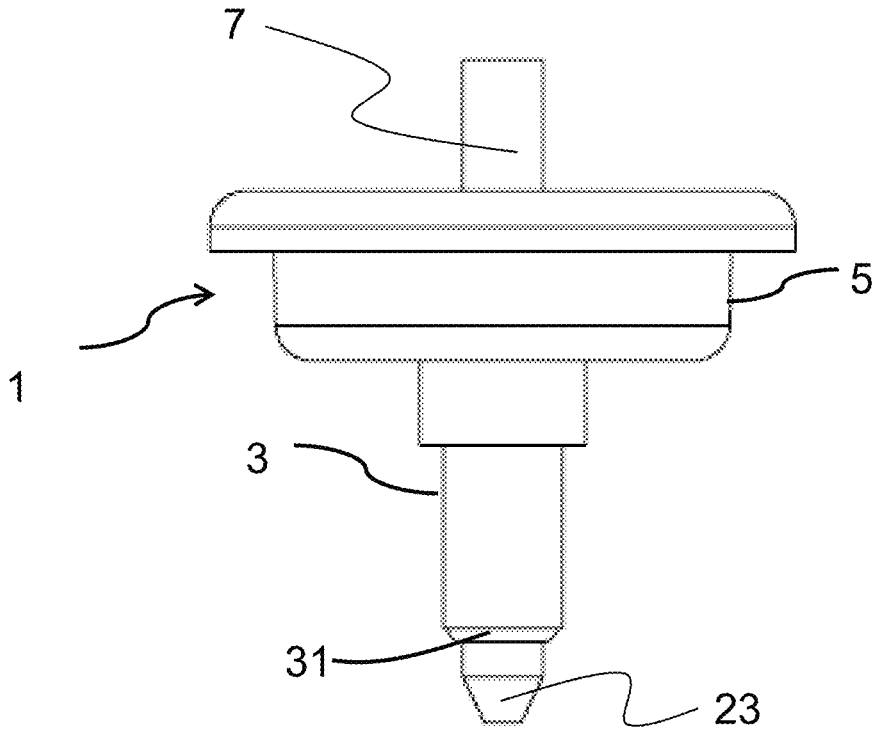
FIG. 4 is a side view of a second embodiment of the present invention in conjunction with a mounting cup illustrating a valve with the valve body tip extending beyond the valve housing.
Figure 5A:
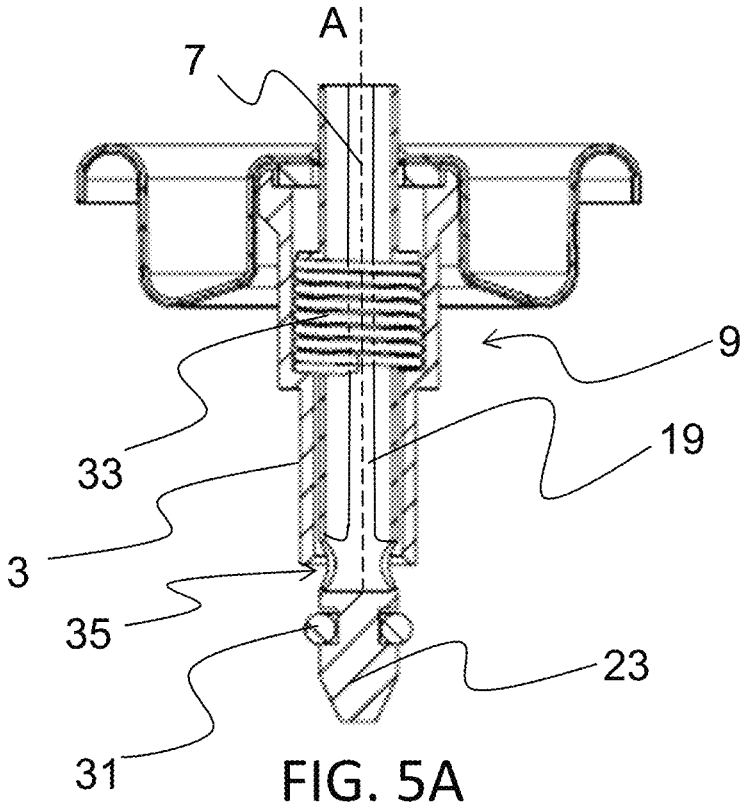
FIG. 5A is a cross-sectional view of a second embodiment of the present invention in conjunction with a mounting cup illustrating a fully closed position.
Figure 5B:
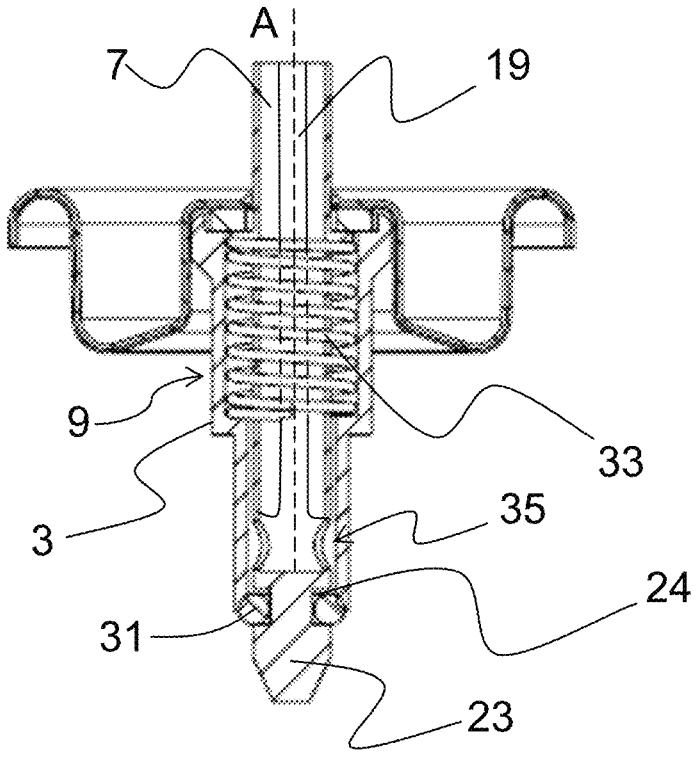
FIG. 5B is a cross-sectional view of a second embodiment of the present invention in conjunction with a mounting cup illustrating a semi-opened position.

FIGS. 4, 5A, and 5B show a second embodiment of the present invention which is not a bag-on-valve embodiment wherein the fitment for a B-O-V valve is not used and the end sealing portion 23 extends directly into an aerosol container with pressurized fluid product (not shown). It is to be appreciated that a dip tube could also be attached to the end of the valve body 3 for conventional style aerosol container's as necessary. FIG. 5A shows the second embodiment in an open state allowing the product in the product bag to communicate with the valve stem 7 through the bores 35. FIG. 5B shows the second embodiment in a fully closed state with the lower sealing ring 31 preventing product from flowing into the valve stem 7. The bores 35 in this embodiment are shown having a circular profile as opposed to the straight or rectangular profile shown in FIGS. 3A-3B.

Figure 6:
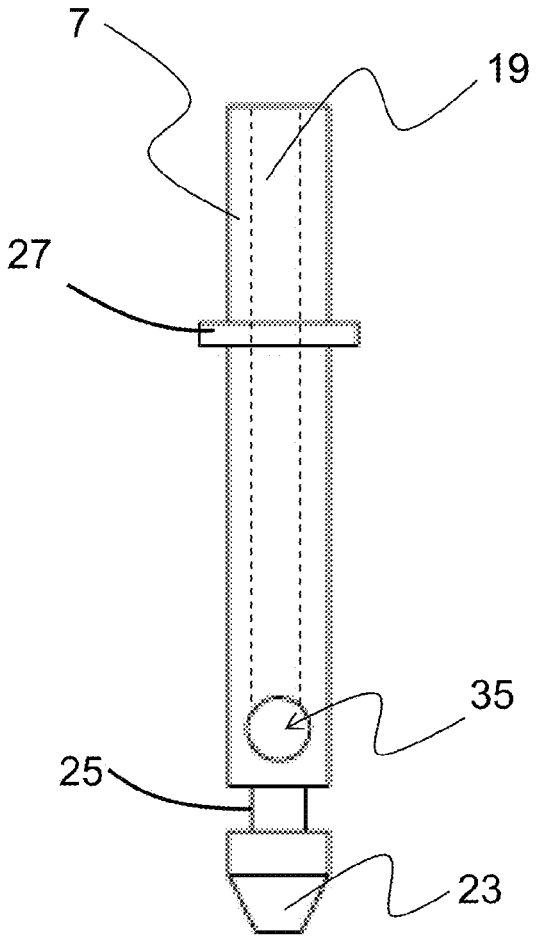
FIG. 6 is a side view of the valve body of the second embodiment of the present invention.

Another important aspect of the present invention is the shape of the bores 35 which can facilitate control over dispensing of product at a high flow rate through the valve. FIG. 6 illustrates a side view of the valve stem 7 of the second embodiment with the bore 35 having a substantially circular shape. The bore 35 is a radial orifice in the sidewall of the valve stem 7, and adjacent the lower end thereof, which can be of a larger diameter than the 1.02 mm-1.52 mm (0.04-0.06 in.) diameter opening conventionally known, for example a diameter of between about 1.02 mm-3.81 mm (0.04-0.15 in) and more preferably in the range of about 2.03 mm-3.05 mm (0.08-0.12 in.) The larger bores 35 do not significantly affect the structural integrity of the valve stem 7 since the bores 35 are close to the bottom end of the valve stem where radial forces from depression and actuation of the valve stem 7 by a user are insignificant. Axial forces can significantly damage the valve stem where the radial opening is located closer to the top end of the valve stem 7 which the user pushes adjacent the inner gasket 29 as in the known valves. The larger bores 35 permit a high amount of product volume to flow at a high flow rate through the passage 19 of the valve stem 7 and travel out to the environment.

Figure 7:
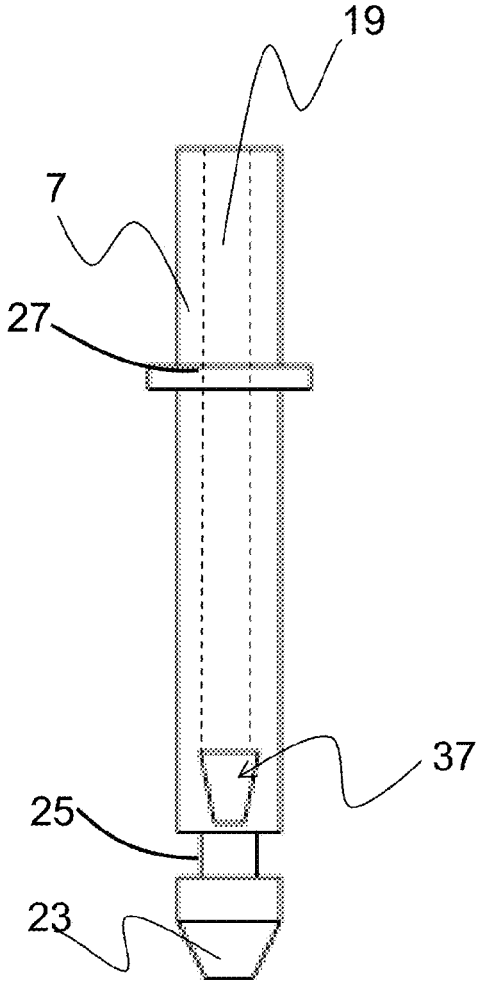
FIG. 7 is a side view of the valve body with an exemplary bore.

The radial bores or passages can be formed in a desired shape or size to facilitate product flow. In another embodiment of the present invention, the bores are designed to have a profile and area so that depending on how far down the valve stem 7 is pressed relative to the sealing edge 24, a desired variable flow rate can be achieved which depends on how exposed the bore 35 is. Different shapes and sizes may be used for different products and end results. For example, FIG. 7 shows an embodiment of a valve stem 7 having an exemplary radial bore 37 shaped as a polygon, that increases axially in area as the valve stem 7 and bore 37 is moved further axially along relative to the sealing edge 24 of the valve body 3. In the case of the polygon shown in FIG. 7, as the valve stem 7 is pushed axially downwards relative to the sealing edge 24, a larger cross-sectional area of the polygon bore 37 becomes more directly exposed to the product in the container and thus permits an increase in relative product flow the more the valve stem 7 is depressed. The polygon and circular bores shown in these figures are just two examples of the type of larger bore shapes that can facilitate the ability of a user to dispense larger volumes of product at increased flow rates where the bores 35, 37 are located near the bottom end of the valve stem 7.

Figure 8:
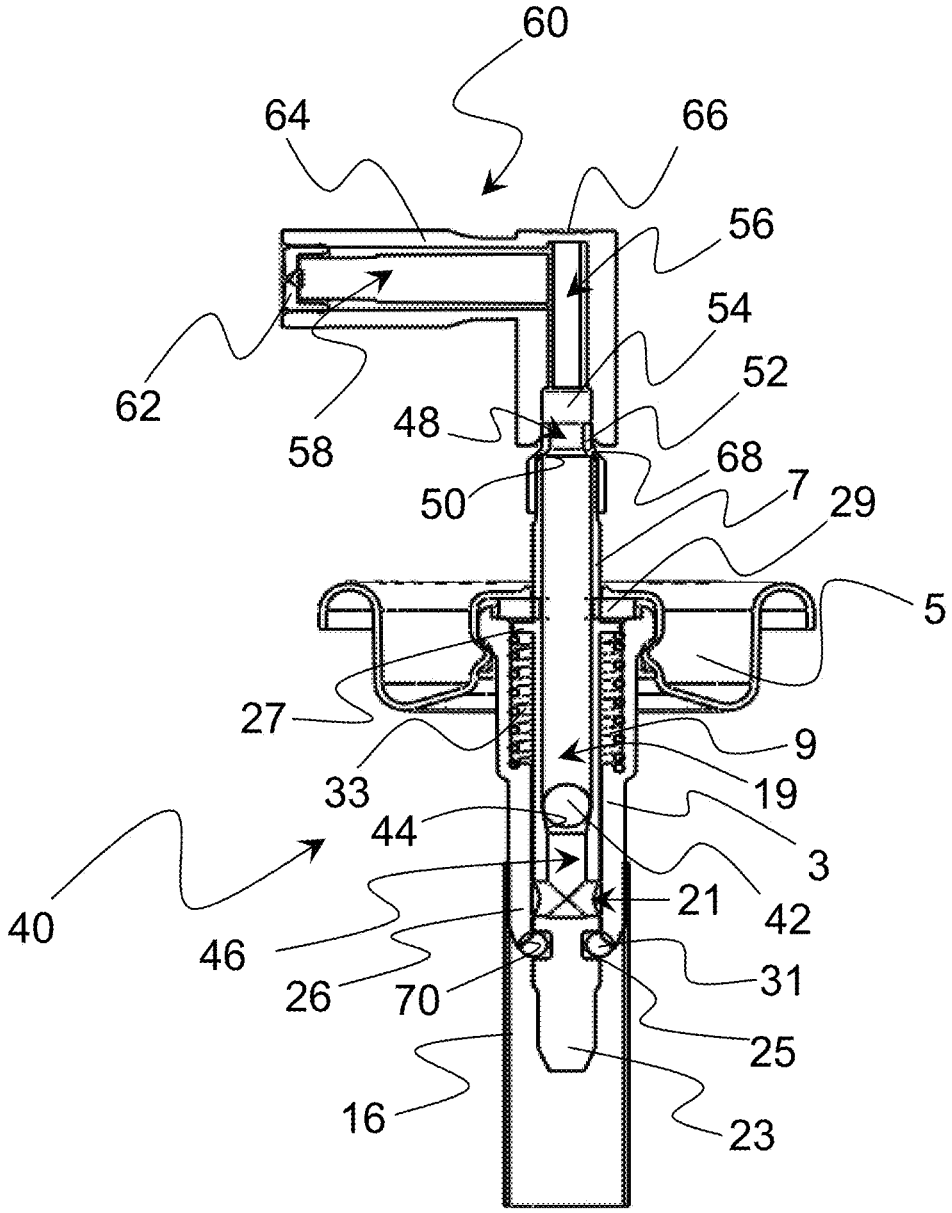
FIG. 8 is a side view of a further embodiment of a metering valve of the present invention in an initially closed unactuated position.

In a further embodiment of the present invention, a metering valve 40, as shown in FIG. 8, has a metering device in the form of a ball 42 located within the valve stem 7. The metering valve 40 includes a lower sealing rim 44 that is tapered from the larger diameter of the valve stem passage 19 to a smaller diameter axial inlet passage 46 that extends from the radial bores 21 to deliver product from the container to the valve stem 7. At the outlet orifice 48, the valve stem 7 has a tapered upper sealing rim 50 with the outlet orifice 48 being smaller in diameter than largest diameter of the metering ball 42. An actuator 60 may be affixed to the valve stem 7 using a coupling 52 or other fitting that is inserted in the base 54 of the actuator and over the valve stem 7 to align the outlet orifice 48 of the valve stem 7 with the axial outlet passage 56. Product may be dispensed axially from the container or radially as shown through a connected passageway 58 that extends to a nozzle 62 to dispense the product as an aerosol mist. The actuator housing 64 may have an actuator button 66 that is depressed to actuate the metered valve 40. One or more micro vents 68 or other conduits may direct air flow to the valve stem 7 to release the metering ball 42 from the upper sealing rim 50 after dispensing product to reproducibly dispense the predetermined quantity from the container.

The metering valve 40 of the present invention is different from metering valves of the prior art where the metering device 42 is the only component within the valve stem 7. There are no complicated components or springs, but instead the sealing of the container using the sealing ring 31 positioned below the lower sealing rim 44 within the valve stem 7 provides for a metering chamber to be formed within the valve stem 7. This metering chamber is sealed using the metering device 42 at the bottom on the lower sealing rim 44 and at the top at the upper sealing rim 50. The sealing ring 31 seals against the lower edge 26 of the valve housing 3 with the lower edge 26 being formed with a concave curvature 70 to mate with and seal the lower edge against the sealing ring 31.

Figure 9:
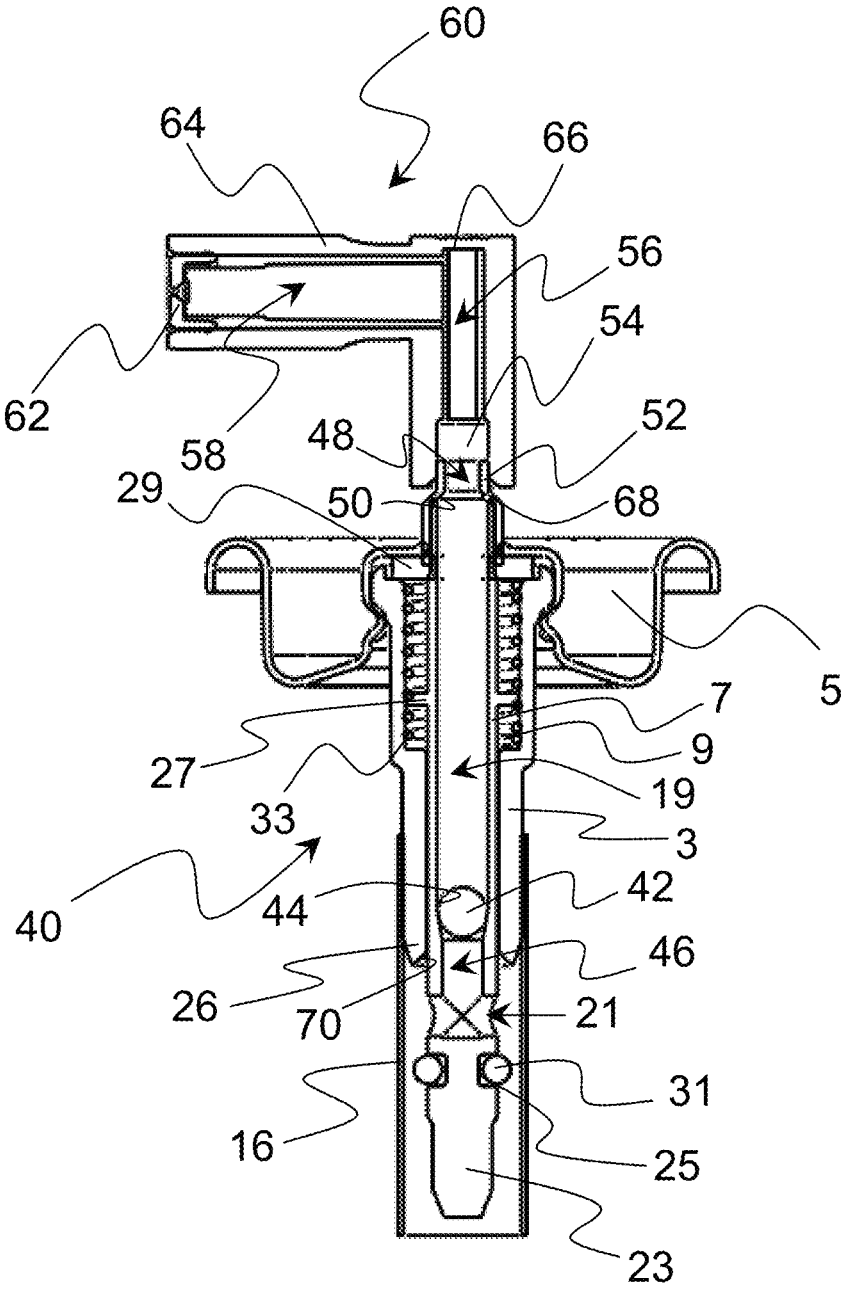
FIG. 9 is a side view of the further embodiment of the metering valve of the present invention in an opened actuated position for priming.
Figure 10:
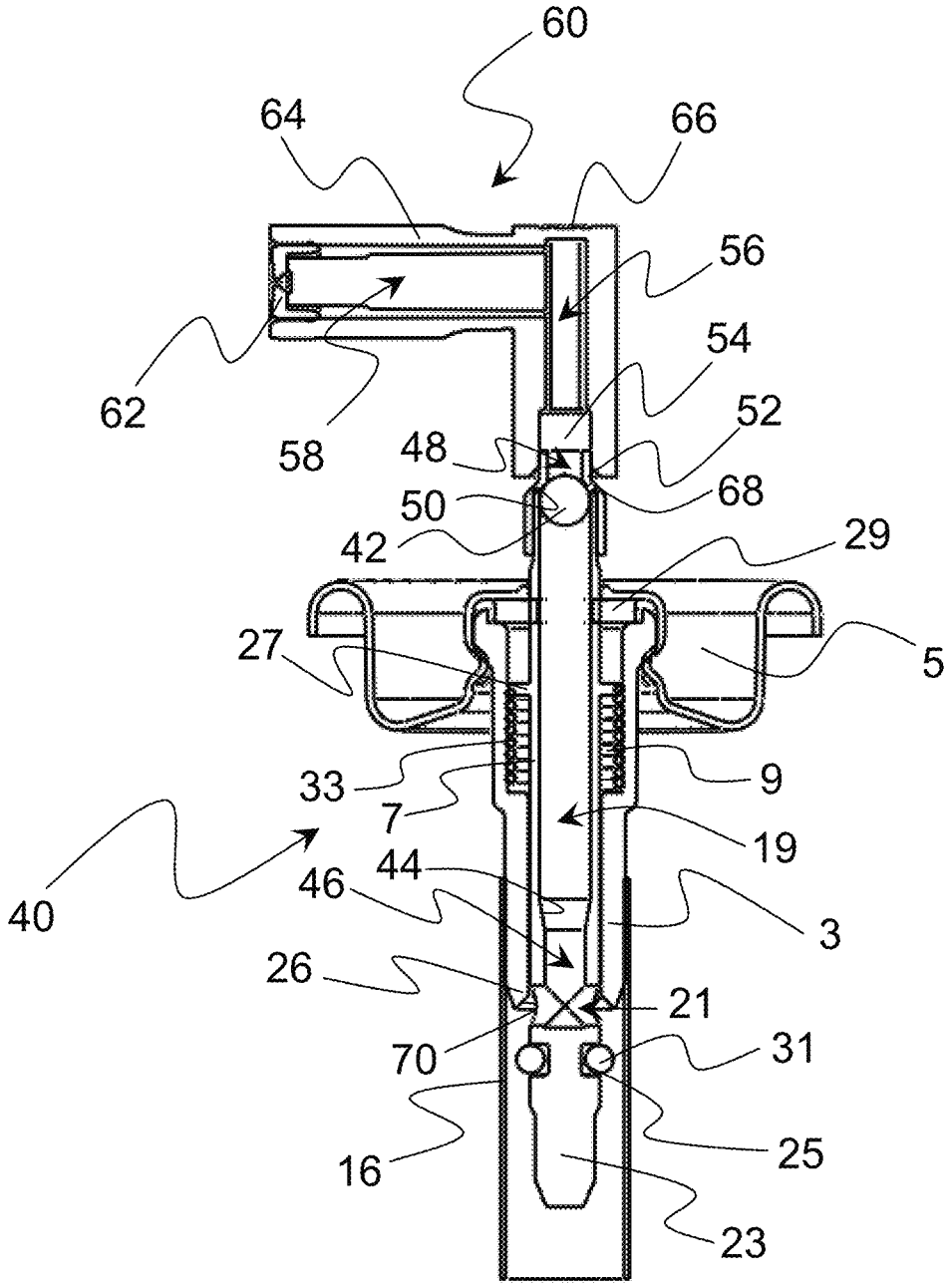
FIG. 10 is a side view of the further embodiment of the metering valve of the present invention in an opened actuated position for priming.

As shown in FIG. 8, in an initial unactuated priming position the metering ball 42 is in a rest position on the lower sealing rim 44. The metering chamber within the passageway 19 of the valve stem 7 is empty. In this closed position, the lower edge 26 of the valve housing 3 is sealed by the sealing ring 31 with the concave curvature 70 of the edge 26 providing a recess for the sealing ring 31 to seal against. In order to initially fill the metering chamber, the actuator button 66 is fully or partially depressed separating the sealing ring 31 from the lower edge 26 and delivering product from the container through the radial bores 21 and into the inlet orifice 46, as shown in FIG. 9. As product flows into the inlet orifice 46, the ball 42 is forced up off of the lower sealing rim 44 and product flows into the metering chamber within the passageway 19 of the valve stem 7. The in-rushing product pushes the ball 42 up through the passageway 19 until the ball 42 is stopped by the upper sealing rim 50 as shown in FIG. 10. Because the valve stem 7 serves as the metering chamber, the propellant of the container, acts directly on the metering device 42 to dispense the pre-determined quantity of product from the valve stem 7 providing for compressed gas such as nitrogen or $CO_2$ under pressure to be used as the propellant.

Figure 11:
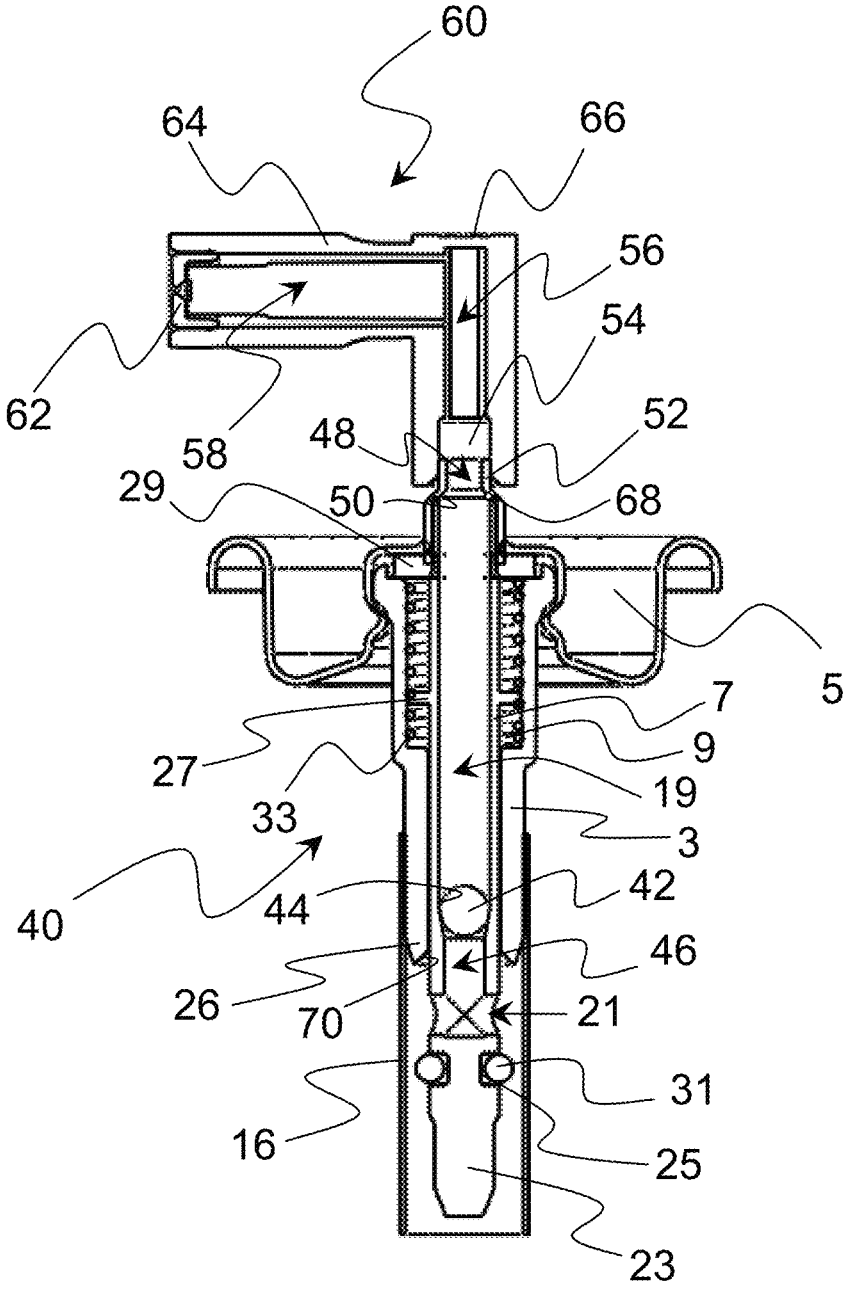
FIG. 11 is a side view of the further embodiment of the metering valve of the present invention in a closed unactuated position.

In initially priming the valve 40, the metering chamber 19 is filled, however product is not dispensed through the actuator 60 because the valve stem is initially empty and requires priming by fully or partially compressing the valve button 66 to fill the chamber 19. At this initial priming step, the ball 42 seals against the upper sealing rim 50 preventing product from discharging. The ball 42 then drops through the product filled chamber 19 and seals against the lower sealing rim 44 which stops the flow of product from the container into the chamber 19, as shown in FIG. 11.

Figure 12:
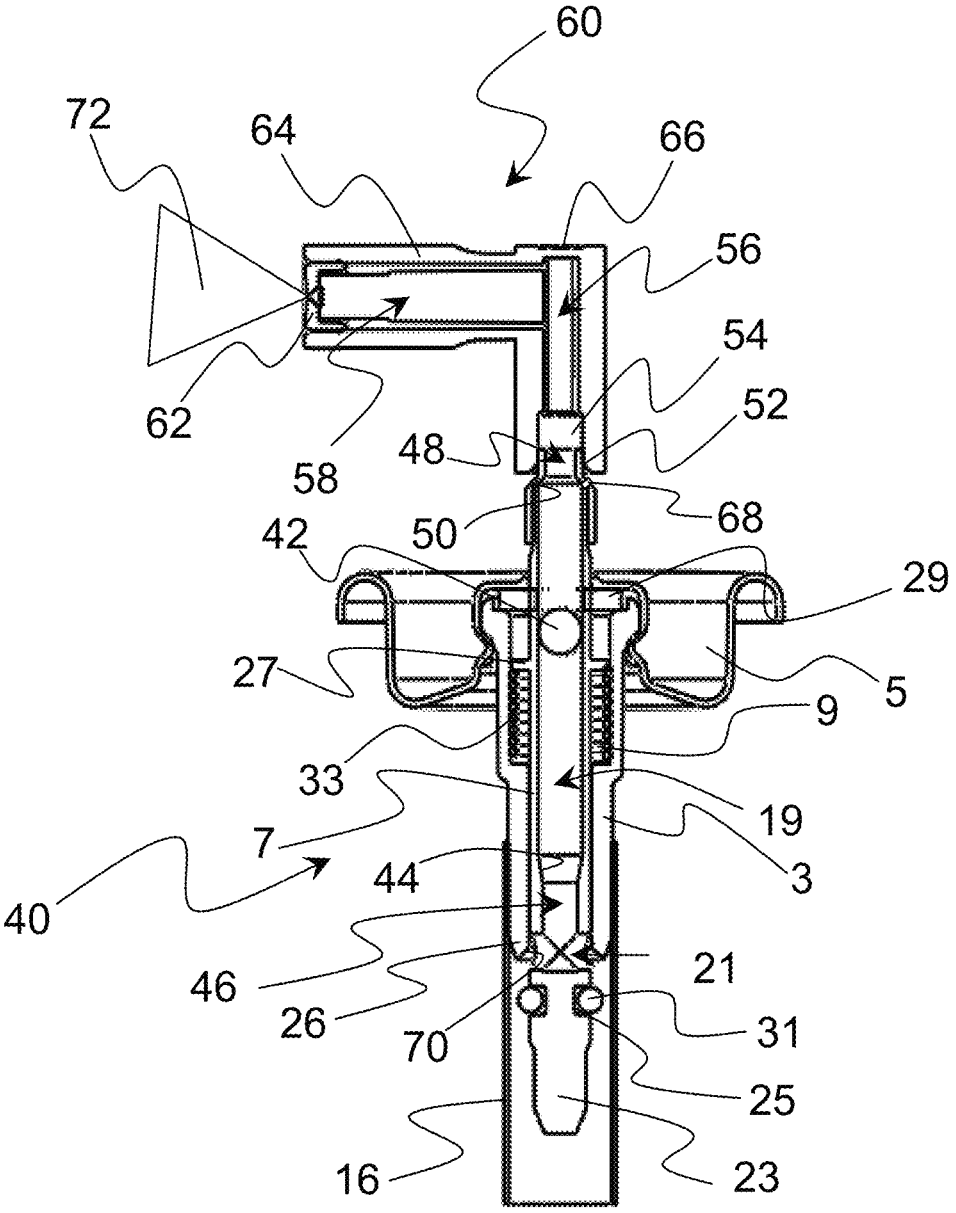
FIG. 12 is a side view of the further embodiment of the metering valve of the present invention in an open actuated dispensing position.
Figure 13:
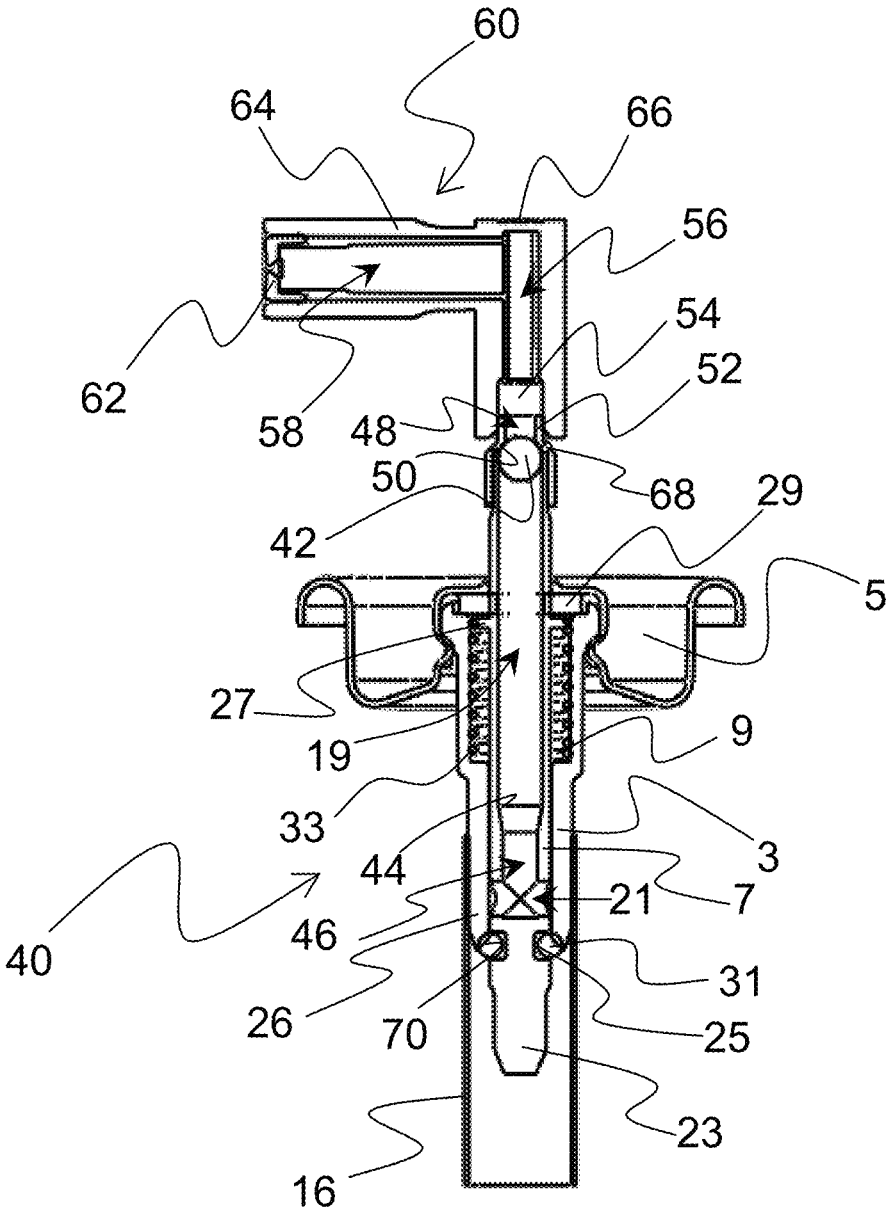
FIG. 13 is a side view of the further embodiment of the metering valve of the present invention in an open partially actuated position with the metering device sealing the outlet orifice of the valve stem.
Figure 14:
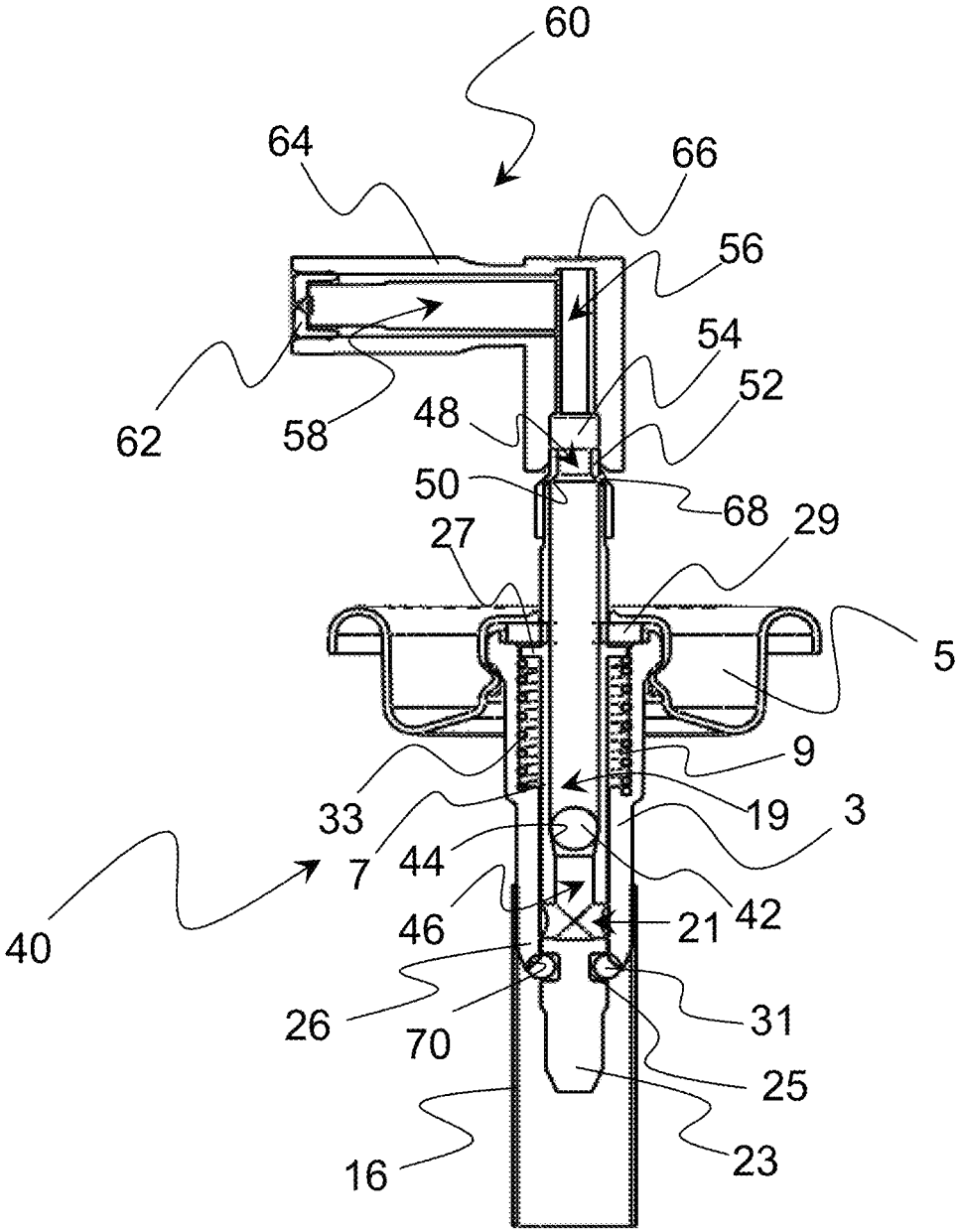
FIG. 14 is a side view of the further embodiment of the metering valve of the present invention in a closed primed unactuated position with the metering device sealing the inlet orifice of the valve stem.

The metered valve 40 now primed is ready for dispensing. By depressing the actuator button 66, product flows from the metered chamber 19 within the valve stem 7 and out through the outlet orifice 48, through the axial passageway 56 of the actuator 60 and out through the radial passageway 58 and nozzle 62 with the spray designated as 72 in FIG. 12. In this actuated position the sealing ring 31 is separated from the lower edge 26 of the valve housing 3 filling the metering chamber 19. The ball 42 travels up through the valve stem passage 19 and seals against the upper sealing rim 50 stopping flow of product from entering the outlet orifice 48 thereby stopping dispensing from the nozzle 62. As the valve button 66 is released the valve 40 may be in a partially actuated position that provides for air to enter the passage chamber 19 through one or more micro-vents 68 or other conduit that communicates with the valve stem 7 to break the seal and release the ball 42 from the upper sealing rim 50, as shown in FIG. 13. The ball 42 falls through the product filled chamber 19 and seals the chamber 19 from the container as the ball 42 settles in a rest position on the lower sealing rim 44 as shown in FIG. 14. In this unactuated position the convex curvature 70 of the lower edge 26 of the valve body 3 provides a recess for the sealing ring 31 stopping flow to the inlet orifice 46 of the valve stem 7. In this manner pre-determined quantities of product are dispensed from the metering chamber 19 on each actuation of the metering valve 40 without requiring complicated components such as multiple springs, plungers or other mechanisms within the valve stem 7.

Since certain changes may be made in the above described improved continuous dispensing actuator assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method of making an actuator for dispensing a predetermined quantity of product from an aerosol container, the method comprising the steps of:

engaging a valve housing with a mounting cup and a gasket, and defining a cavity in the valve housing and coupling a dip tube to the actuator via direct contact only between the dip tube and an axially lower most end of the valve housing;

partially accommodating a valve stem within the cavity of the valve housing and captively retaining the valve stem by the mounting cup and the gasket, projecting an upper end portion of the valve stem from an upper end of the valve housing and through the gasket and the mounting cup, projecting a lower end portion of the valve stem from the axially lower most end of the valve housing, and defining a central passage in the valve stem for dispensing pressurized product from at least one radial bore inlet, located adjacent the lower end portion of the valve stem, to a dispensing orifice, located adjacent the upper end portion of the valve stem;

providing a stop on an exterior central portion of the valve stem and a spring directly abutting against the stop and biasing the stop against the gasket supported by a lower surface of the mounting cup;

retaining a movable metering ball within the valve stem between the at least one radial bore inlet and the dispensing orifice, with the metering ball being movable between spaced apart upper and lower sealing rims, and locating the lower sealing rim within the cavity defined by the valve housing, between the stop and the at least one radial bore inlet;

forming an annular groove, supporting a sealing ring, on the lower end portion of the valve stem which projects from the axially lower most end of the valve housing, and the sealing ring, when the stop abuts against the gasket, engaging and sealing against the axially lower most end of the valve housing;

forming the at least one radial bore inlet in a sidewall of the valve stem adjacent the sealing ring, and accommodating the at least one radial bore inlet within the valve housing, when the stop abuts against the gasket, and locating the at least one radial bore inlet outside the valve housing and below the axially lower most edge of the valve housing, when the valve stem is depressed, such that the at least one radial bore inlet radially directly faces the dip tube for forming a flow path into the central passage for the product to be dispensed; and moving the metering ball within the valve stem from a rest position, sealingly engaged with the lower sealing rim, to an actuated position in which the metering ball sealingly engages with the upper sealing rim and dispenses a pre-determined quantity of product from the valve stem, and then returning the metering ball, once the stop again abuts against the gasket, back to the rest position for another product dispensing cycle.

2. The method according to claim 1, further comprising the step of forming at least one micro groove, channel or vent in a surface of the upper sealing rim, with the at least one micro groove, channel or vent permitting air to flow toward the upper sealing rim and break a surface tension, between the metering device and the upper sealing rim, and thereby release the metering device from its sealing engagement with the upper sealing rim so that the metering device can move, through the product contained within a metering chamber, back into sealing engagement with the lower sealing rim.

3. The method according to claim 1, further comprising the step of engaging the dip tube with the axially lower most end of the valve housing so that, when the valve stem is depressed, the at least one radial bore inlet is axially located outside and below the axially lower most end of the valve housing and opens in a radial direction only to the dip tube thereby forming the flow path into the central passage for the product to be dispensed.

4. A metering valve for use in a pressurized aerosol application, the metering valve comprising;

a valve housing having an outer surface engaged with a mounting cup and the valve housing defining a cavity therein, the valve housing engaging a first end of a dip tube along an axial interface, the dip tube having a second end which communicates with pressurized product to be dispensed;

a valve stem being partially accommodated within the cavity of the valve housing and being captively retained by the mounting cup, the valve stem defining a central passage for dispensing the pressurized product from at least one radial bore inlet to a dispensing orifice located outside the valve housing, the valve stem having a stop, and a spring abutting against and biasing the stop of the valve stem against a gasket which is supported by an undersurface of the mounting cup;

a metering device being located within the valve stem between the at least one radial bore inlet and the dispensing orifice, the metering device being movable between spaced apart upper and lower sealing rims, and the lower sealing rim being located within the cavity defined by the valve housing, between the stop and the at least one radial bore inlet;

a lower end portion of the valve stem extending out from an axially lower most edge of the valve housing and communicating with product to be dispensed, and the lower end portion of the valve stem supporting a sealing ring which, when the stop abuts against the gasket, engages and seals against the lower most edge of the valve housing, the lower most edge of the valve housing being located below the axial interface;

the at least one radial bore inlet being formed in a sidewall of the valve stem adjacent the lower end portion of the valve stem and the at least one radial bore inlet being accommodated within the valve housing when the stop abuts against the gasket, and, when the valve stem is depressed into an actuated position, the at least one radial bore inlet being located outside the valve housing and axially below the axial interface and the lower most edge of the valve housing and forming a flow path for the product to the central passage; and the metering device, when the valve stem is actuated, being longitudinally movable, within the valve stem, from a rest position to an actuated position in which the metering device sealingly engages with the upper sealing rim, and, as the metering device moves from the rest position to the actuated position, the metering device dispensing a pre-determined quantity of product from the valve stem, and the metering device then eventually returning back to the rest position, for another product dispensing cycle, once the valve is closed and the stop again abuts against the gasket.

5. The metering valve of claim 4, wherein a propellant within the container of the pressurized product acts on the Metering device to dispense the pre-determined quantity of product.

6. The metering valve of claim 5, wherein the propellant is a compressed gas.

7. The metering valve of claim 4, further comprising at least one micro-vent formed in the upper sealing rim of the valve stem.

8. The metering valve of claim 4, wherein the upper sealing rim of the valve stem is circumferentially tapered and the dispensing orifice has a smaller diameter than a diameter of the metering device.

9. The metering valve of claim 4, wherein the at least one radial bore inlet comprises a first radial bore and a second radial bore located in the lower end portion of the valve stem, below the lower sealing rim, and the first bore is located opposite the second bore.

10. The metering valve of claim 4, wherein the lower sealing rim of the valve stem is circumferentially tapered from a diameter of the valve stem to the central passage extending from the radial bore.

11. The metering valve of claim 4, wherein the metering device is one of a stainless steel ball, a ceramic ball or a plastic ball.

12. The metering valve of claim 4, wherein the lower sealing edge of the valve housing comprises a concave curvature which accepts and seals against the sealing ring.

13. The metering valve of claim 4, wherein the dip tube is affixed to the valve housing along the axial interface and when the valve stem is depressed, the at least one radial bore inlet is located axially below the axial interface and the lower most edge of the valve housing and directly radially faces the dip tube for supplying product to the central passage.

14. The metering valve of claim 4, wherein the at least one bore in the valve stem has a polygon shape decreases in cross-sectional area towards the lower most end of the valve stem.

15. The metering valve of claim 4, wherein the at least one radial bore is sized to permit greater flow of the product into the central passage, without compromising an integrity of the valve stem.

16. The metering valve of claim 4, wherein each at least one radial bore has a diameter greater than 1.02 mm 1.52 mm (0.04-0.06 in.).

17. A metering valve for use in a pressurized aerosol application, the metering valve consisting of:

a valve housing having an upper end and an axially opposed lower most end, the upper end of the valve housing being engaged with a mounting cup and a gasket, and the valve housing defining a cavity therein, and the lower most end of the valve housing having an interface, a dip tube directly engages the metering valve only via the interface;

a valve stem being partially accommodated within the cavity of the valve housing and being captively retained by the mounting cup and the gasket, an upper end portion of the valve stem projecting from the upper end of the valve housing and extending through the gasket and the mounting cup, while a lower end portion of the valve stem axially projecting out from the lower most end of the valve housing past the interface between the lower most end of the valve housing and the dip tube, and the valve stem defining a central passage for dispensing pressurized product from at least one radial bore inlet, located adjacent the lower end portion of the valve stem, to a dispensing orifice located adjacent the upper end portion of the valve stem;

an exterior central portion of the valve stem supporting a stop and a spring directly abutting against the stop and biasing the stop against the gasket supported by a lower surface of the mounting cup;

a movable metering ball being retained within the valve stem between the at least one radial bore inlet and the dispensing orifice, the metering ball being movable between spaced apart upper and lower sealing rims, and the lower sealing rim being located within the cavity defined by the valve housing, between the stop and the at least one radial bore inlet;

the lower end portion of the valve stem, which axially projects from the lower most end of the valve housing, comprising an annular groove supporting a sealing ring, and the sealing ring, when the stop abuts against the gasket, engaging and sealing against a lower sealing surface and the lower most end of the valve housing;

the at least one radial bore inlet being formed in a sidewall of the valve stem adjacent the sealing ring, and the at least one radial bore inlet being accommodated within the valve housing, when the stop abuts against the gasket, and the at least one radial bore inlet being axially located outside and axially below the lower most end of the valve housing, when the valve stem is depressed, such that the at least one radial bore inlet directly radially faces the dip tube for forming a flow path into the central passage for the product to be dispensed; and the metering ball being movable within the valve stem from a rest position, sealingly engaged with the lower sealing rim, to an actuated position in which the metering ball sealingly engages with the upper sealing rim and dispenses a pre-determined quantity of product from the valve stem, and the metering ball, once the stop again abuts against the gasket, then returning back to the rest position for another product dispensing cycle.

18. The metering valve according to claim 17, wherein at least one micro groove, channel or vent is formed in a surface of the upper sealing rim, and the at least one micro groove, channel or vent permits air to flow toward the upper sealing rim and break a surface tension, between the metering device and the upper sealing rim, and thereby release the metering device from its sealing engagement with the upper sealing rim so that the metering device can move, through the product contained within a metering chamber, back into sealing engagement with the lower sealing rim.

19. The metering valve according to claim 17, wherein the dip tube engages and surrounds the lower most end of the valve housing and, when the valve stem is depressed, the at least one radial bore inlet is axially located outside and below the lower most end of the valve housing such that the at least one radial bore inlet opens to only the dip tube in a radial direction, thereby forming the flow path into the central passage for the product to be dispensed.

* * * * *